United States Patent [19]

Kerzner

[11] Patent Number: 4,545,522

[45] Date of Patent: Oct. 8, 1985

[54] INDOOR MAIL SLOT COVER TO PREVENT HEAT LOSS THROUGH MAIL SLOTS

[76] Inventor: Gary D. Kerzner, 1044 Mora Pl., Woodmere, N.Y. 11598

[21] Appl. No.: 624,378

[22] Filed: Jun. 25, 1984

[51] Int. Cl.[4] ..... E05D 7/00

[52] U.S. Cl. ..... 232/45; 49/402; 49/482

[58] Field of Search ..... 232/45, 47; 49/399, 49/400, 401, 402, 482; 220/254, 287

[56] References Cited

U.S. PATENT DOCUMENTS

| | | | |
|---|---|---|---|
| 460,783 | 10/1891 | Markell | 232/25 |
| 746,906 | 12/1903 | Wimer | 232/45 |
| 1,046,784 | 12/1912 | Hartman | 232/23 |
| 1,305,722 | 6/1919 | Kees | 232/23 |
| 1,817,191 | 8/1931 | Harmony | 232/25 |
| 2,437,319 | 3/1948 | Gable et al. | 232/45 |
| 2,595,535 | 5/1952 | Nowakowski | 232/45 |
| 2,658,667 | 11/1953 | Mirkin | 232/23 |
| 3,737,066 | 6/1973 | Ames | 220/254 |
| 4,094,271 | 6/1978 | Louis | 49/482 X |
| 4,095,640 | 6/1978 | Beckerer, Jr. | 49/402 X |

FOREIGN PATENT DOCUMENTS

| | | | |
|---|---|---|---|
| 1442675 | 7/1976 | United Kingdom | 232/45 |
| 1599642 | 10/1981 | United Kingdom . | |

*Primary Examiner*—Robert P. Swiatek

*Attorney, Agent, or Firm*—David M. Rosenblum

[57] ABSTRACT

An indoor mail slot cover that can be weather-stripped is provided to prevent heat loss through mail slots. The mail slot cover has a cover flap, separable hinge sections connected to the cover flap and separable lug sections connected to the hinge sections. In a preferred embodiment the cover flap, lug sections and hinge sections can be formed from a rectangular plastic plate. The plate is provided with grooves, which form the hinge and lug sections in the plate and which permit portions of the cover flap, hinge sections and lug sections to be broken off and discarded to thereby reduce the size of the mail slot cover in accordance with the size of the mail slot. An adhesive ferrite strip and an adhesive magnetic strip arrangement can be provided to secure the cover flap in a closed position. Attachment tabs can additionally be provided to secure the mail slot cover to the building structure.

15 Claims, 8 Drawing Figures

1
52
26d
26
20
59
24
18c
20c
22
26c
18d
53
51
26b
50
16
12
58
40
27
25
42
18a
18b
18
10

52
53
51
26
10
26a
18d
27
24
16
25
22
14
18b
35
12
40
36
18b
16
42

50'
26
10
26b
59
20
24
12
18d
14
22

FIG. 6
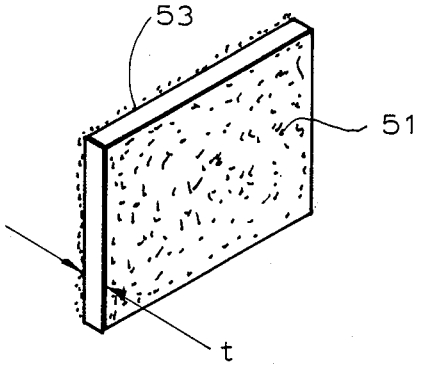
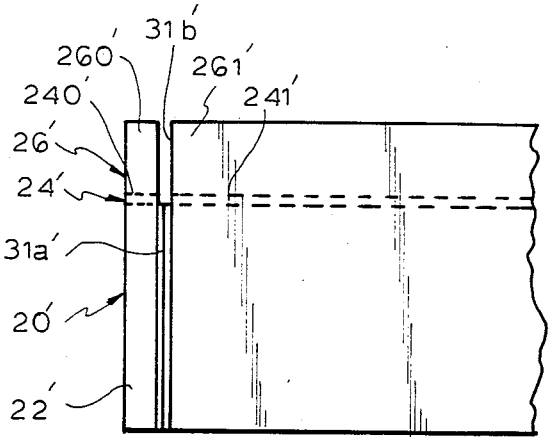
FIG. 8

INDOOR MAIL SLOT COVER TO PREVENT HEAT LOSS THROUGH MAIL SLOTS

FIELD OF THE INVENTION

This invention relates to covers to prevent heat loss through openings in buildings and more particularly to indoor mail slot covers and the like. Still more particularly the invention relates to indoor mail slot covers utilizing weather-stripping wherein the cover size can be reduced in accordance with the size of the mail slot prior to installation.

BACKGROUND OF THE INVENTION

In the home and the workplace, there exists the potential for heat loss through gaps in the sealing of doors, windows and other openings in the building structure. Conventionally, attempts are made to minimize such heat loss by weather-stripping, caulking and otherwise sealing such gaps. In this regard, there exists a potential for heat loss through mail slots, typically situated in or alongside entrance doors. Such conventional attempts at sealing however, have little practical application to mail slots. For instance, while it appears practical to weather-strip mail slots about the outer peripheral edges of the mail slot underlying the outside mail slot door, such weather-stripping utilization simply exacerbates the problem in that it prevents the outside door from fully closing.

There has been at least one patent directed towards the need to insulate mail slots. U.S. Pat. No. 2,437,319 entitled AIR TIGHT MAIL SLOT, which issued to P. T. Gable et al on Mar. 19, 1948 provides an air tight mail slot insert incorporating doors on the inside and the outside of the mail slot. The construction of this insert includes an inwardly pivoting, elliptically shaped door covering the outside opening of the mail slot and a vertically sliding door located on the inside of the mail slot. The outside door is provided with a downwardly extending pin. When the outside door is pushed inwardly into an open position, the pin coacts with a flange attached to the inside door to simultaneously raise the inside door into an open position.

In this regard, designs for mail slots and building receptacles have incorporated inside doors for a variety of purposes. For instance, British Provisional Patent Specification entitled AN IMPROVEMENT IN OR RELATING TO THE PROVISION OF LETTER BOXES IN WOODEN DOORS, which issued to G. Platt et al on Oct. 1, 1981, provides a pair of inside and outside pivotable doors mounted on a casement type of insert. This casement is to be utilized within a rough hewn slot-like opening in a door to thereby save the time and the expense involved in finishing the opening. A more common purpose is for convenience of deposit and collection of oversized articles. U.S. Pat. No. 460,742 entitled HOUSE DOOR LETTER BOX, which issued to E. Markell on Oct. 6, 1891 provides an outwardly pivoting indoor mail slot door for the receipt of letter sized articles and an outdoor receptacle for oversize packages.

The teachings of such prior art inventions, as discussed above, are limited to the provision of inside doors on frames and casements which are in turn installed within newly constructed mail slots. They therefore, do not provide the consumer with an adequate and inexpensive means to seal conventional existing mail slots without completely rebuilding the existing mail slot and discarding the used mail slot hardware. This is because mail slots are not uniform in size; and thus the insert and casement structures disclosed by the prior art patents would not fit within different sized mail slots without modification to the mail slot by enlargement or reduction.

The present invention, therefore contemplates the provision of an indoor mail slot cover to be utilized without modification of the existing mail slot or mail slot hardware. However, because the building structure can limit the amount of space available for the installation and because mail slots are not uniform in size, the present invention encompasses means to reduce the size of the mail slot cover in accordance with such attendant space restrictions and with the size of the mail slot. Moreover, since the indoor mail slot cover can be utilized within the interior of the home, there are esthetic considerations which necessitate a neat and professional appearing installation. Such esthetic consideration often require reduction of the size of the mail slot cover in accordance with the size of the mail slot.

SUMMARY OF THE INVENTION

In accordance with the present invention, there is provided an indoor mail slot cover that can be reduced in size prior to installation in accordance with the size of the mail slot. The indoor mail slot cover of the present invention can seal the mail slot by covering the mail slot and a weather-stripping arrangement installed about the mail slot. The weather-stripping arrangement can either be installed directly on the building structure or a mail slot bezel plate attached to the building structure.

The indoor mail slot cover of the present invention can comprise a plastic plate. The plate has a cover flap portion sized to cover the mail slot and the weather-stripping arrangement. At least a transversely extending groove is provided. This transversely extending groove is located in at least the cover flap portion and divides the cover flap into a pair of adjacent sections. A lug portion, spaced from the cover flap portion and located directly opposite thereto, is provided for connecting the plate to the building structure. The lug portion has at least a pair of separable lug sections, each of which is located opposite to a section of the cover flap portion. A hinge portion, located between the lug and cover flap portions, is also provided. The hinge portion comprises an integrally formed coined hinge having at least a pair of adjacent separable, hinge sections, each of which connects a lug section to a section of the cover flap. Additionally, means are provided for attaching at least a lug section to the building structure.

Thus, when prior to installation one of the adjacent sections of the cover flap portion is of sufficient size to fully cover the mail slot and weather-stripping arrangement, the other of the adjacent sections of the cover flap portion, simultaneously with a hinge section and a lug section connected thereto, can be broken off along the line of the transversely extending groove. As a result the size of the cover flap portion is thereby reduced. The remaining of the adjacent sections of the cover flap portion is operable for pivotable movement with respect to the mail slot between an opened position, uncovering the mail slot and a closed position, covering the mail slot and the weather-stripping arrangement.

BRIEF DESCRIPTION OF THE DRAWINGS

While the specification concludes with claims particularly pointing out and distinctly claiming the subject matter which is regarded as the present invention, it is believed that the invention will be better understood from the following description taken in connection with the accompanying drawings in which:

FIG. 6 is a perspective view of an attachment tab of the present invention.

FIG. 8 is a fragmentary front elevational view of an alternate embodiment of the present invention.

DESCRIPTION OF THE PREFERRED EMBODIMENT

Figure 2:
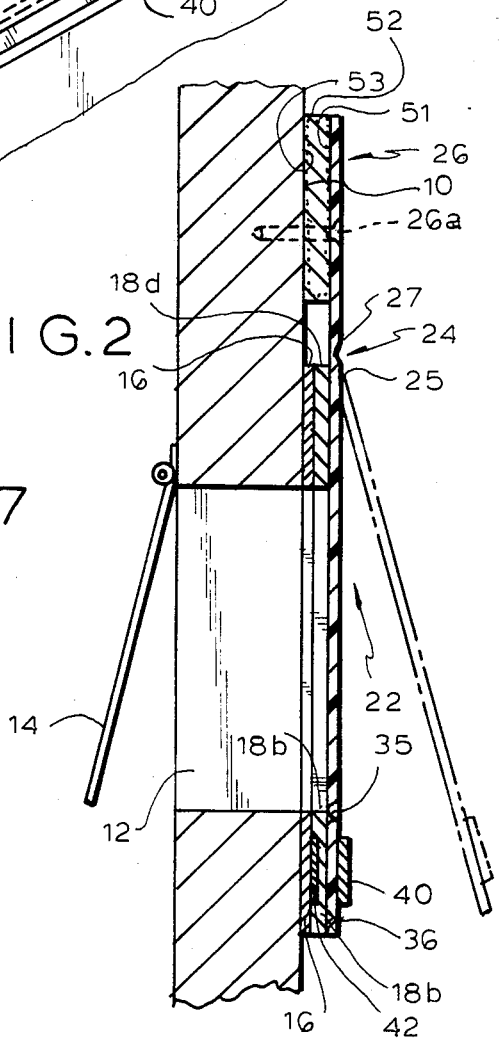
FIG. 2 is a cross-sectional edge view of the mail slot cover of the present invention illustrated in its closed position.
Figure 7:
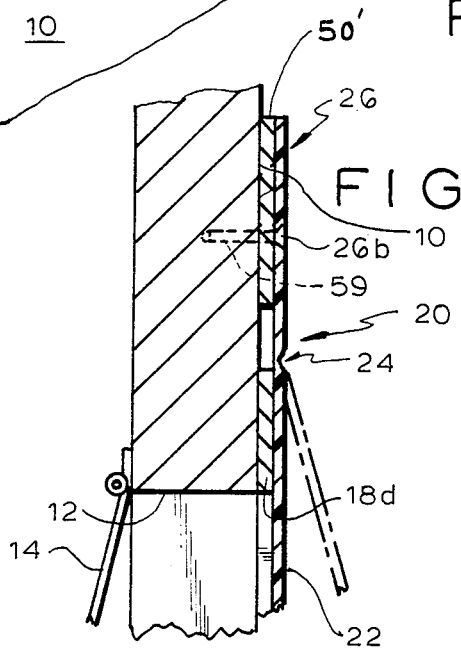
FIG. 7 is an enlarged fragmentary cross-sectional edge view of the mail slot cover of the present invention illustrating a typical alternate installation.

Referring now to the figures, the indoor mail slot cover 1 of the present invention is illustrated as attached to a building structure 10. Building structure 10 is provided with a mail slot 12 having outer door 14. Building structure 10 can be a portion of a door or possibly the framing thereof. Weather-stripping arrangement 18, illustrated in FIG. 5, can be attached to mail slot bezel plate 16 as illustrated in FIG. 2; or can be attached directly to building structure 10 as illustrated in FIG. 7.

Figure 4:
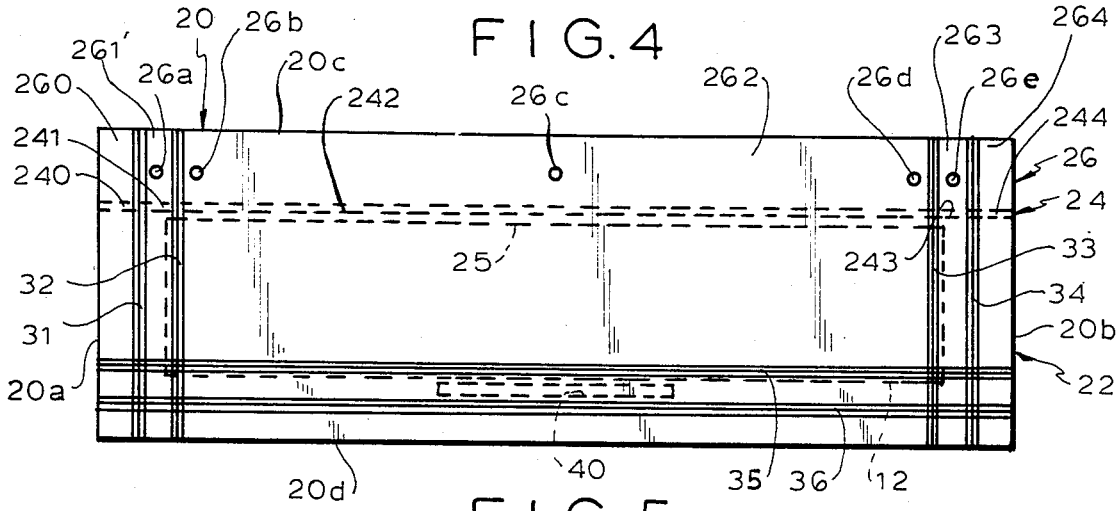
FIG. 4 is a rear elevational view of FIG. 3, showing the size of the Rectangular Plate relative to the size of the mail slot.

Referring now to FIG. 4, the indoor mail slot cover 1 of the present invention can include a cover flap 22, a set of five separable hinge sections 240 through 244 connected to cover flap portion 22 and a set of five separable lug sections 260 through 264, each respectively connected to one of the hinge sections 240 through 244. In the preferred embodiment cover flap 22, hinge sections 240 through 244 and lug sections 260 through 264 are connected by forming cover flap 22 and the aforementioned hinge and lug sections from a plastic plate 20 of rectangular configuration. As such, hinge sections 240 through 244 and lug sections 260 through 264 are as between themselves, connected to each other. Rectangular plate 20 can have a pair of longitudinal edges 20*c* and 20*d* spaced apart from one another and a pair of transverse edges 20*a* and 20*b* spaced apart from one another and connecting the longitudinal edges 20*c* and 20*d* at either end thereof to form the rectangular configuration of plate 20.

Figure 3:
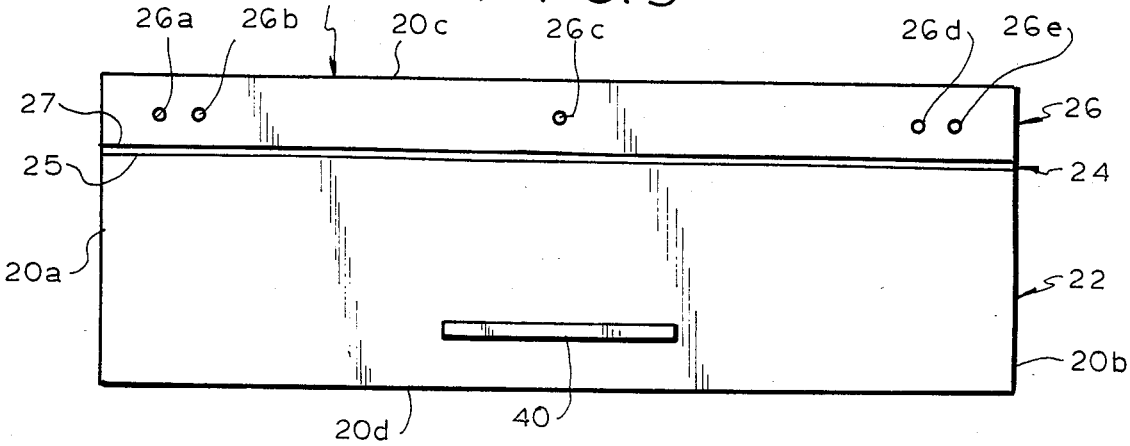
FIG. 3 is a front elevational view of the Rectangular Plate of the present invention forming the cover flap, hinge sections and lug sections thereof, prior to installation and breakage thereof to form the mail slot cover illustrated in FIG. 1.

Referring to FIG. 3, the rectangular plate 20 can have a hinge portion comprising an integrally formed coined hinge 24 dividing plate 20 into two opposite portions wherein one of the portions comprises the cover flap portion 22 (Hereinafter referred to as 'cover flap 22') and the other of the portions comprises a lug portion 26 (Hereinafter referred to as 'lug 26'.). As illustrated in FIG. 4, two pairs of transversely extending grooves 31 through 34 are provided. These grooves, 31 through 34 divide the coined hinge 24 into five adjacent sections which comprise hinge sections 240 through 244; and lug 26 into five adjacent portions which comprise lug sections 260 through 264. The grooves 31 through 34 also permit the length of plate 20 and hence the indoor mail slot cover 1 to be incrementally reduced by the spacing between the grooves 31 through 34 and the transverse edges of plate 20, 20*a* and 20*b*. Longitudinally extending grooves 35 and 36 can also be provided to permit incremental reduction of the width of plate 20 and hence indoor mail slot cover 1 by the spacing between grooves 35 and 36 with the longitudinal edges 20*c* and 20*d* of plate 20.

An adhesive magnetic strip 40 and an adhesive ferrite strip 42 can be provided to secure cover flap 22 in its closed position and hence further increase the sealing of mail slot 12 by cover flap 22.

Referring now to FIGS. 1,2,6 and 7, the plate 20 and its component parts are attached to building structure 10 by provision of attachment tabs 50 nd 52 when a mail slot bezel plate 16 is used. When a mail slot bezel plate 16 is not used, plate 20 is attached to building structure 10 by provision of attachment tabs, such as alternate attachment tab 50' and screws 58 and 59. Screws 58 and 59 can also be used with attachment tabs 50 and 52 as illustrated in the Figures.

Referring again to FIG. 4, the cover flap 22 can be seen to be a portion of plate 20 bounded by lengthwise edge 25 of hinge 24, transverse edges 20*a* and 20*b* and longitudinal edge 20*d*. The cover flap 22 is therefore of planar configuration being part of the plate 20. The cover flap 22 is operable for pivotable movement with respect to the mail slot 12. When the cover flap 22 is in its opened position, the mail slot 12 is uncovered allowing for the ingress of mail. When the cover flap 22 is in its closed position, cover flap 22 covers the weather-stripping arrangement 18, being installed on bezel plate 16 or directly on building structure 10, and mail slot 12 to thereby seal the mail slot 12. Thus, in the closed position, cover flap 22 prevents the escape of warm air or the entry of cold air through the building structure 10. Moreover, since dead air remains in the mail slot 12, the cover flap 22 also serves to somewhat insulate the mail slot 12.

As can well be appreciated, although cover flap 22 is of rectangular configuration, being part of plate 20, it could be of any shape in accordance with any esthetic need.

Pivotable movement of the cover flap 22 is provided by the set of separable hinge sections 240 through 244 formed from integrally formed coined hinge 24. The coined hinge 24 is located between lug 26 and cover flap 22, and extends across the plate 20 in an orientation parallel to the edges 20*c* and 20*d*. The coined hinge 24 is formed by the application to the plate 20 of a heated rod and method well known in the art, to thereby define the two lengthwise extending edges 25 and 27. The coined hinge 24 could be formed in plate 20 so as to define parallel, lengthwise extending edges such as 25 and 27 on both surfaces of the plate 20. In the preferred embodiment, all that is necessary is that the coined hinge 24 be formed only in the surface of the plate 20 facing away from the mail slot 12 as viewed when the mail slot cover 1 is installed.

Lug sections 260 through 264 are formed from the lug 26 of the plate 20. As illustrated, lug 26 is spaced from the cover flap 22 and located directly opposite thereto. The lug sections 260 through 264 are each respectively adjacent to and connected to the hinge sections 240 through 244. The remaining lug sections 260 through 264, after breakage of plate 20 serve to attach plate 20 hence the cover flap 22 to building structure 10. The lug 26 in the preferred embodiment can be defined as that portion of plate 20 bounded by lengthwise edge 27 of hinge 24, transverse edges 20*a* and 20*b* and longitudinal edge 20*c*.

Grooves, 31 through 36, illustrated in FIG. 4, permit the size of cover flap 22 and hence the cover 1 to be reduced in size in accordance with the size of the mail slot 12 without the use of any tools. The grooves can comprise a set of two pairs of transversely extending grooves 31,32 and 33,34, parallel to transverse edges 20*a* and 20*b*. These grooves therefore, are also oriented at right angles to hinge 24. Each of the pairs can preferably be spaced an equal distance from a transverse edge 20*a* and 20*b*. The pairs are spaced apart from one another an interval greater that the distance the pairs are spaced from transverse edges 20*a* and 20*b*.

The grooves 31 through 34 permit an incremental reduction of the length of plate 20 and hence cover 1 by the spacing between the grooves 31 through 34 and the transverse edges 20*a* and 20*b* of the plate 20. The grooves 31 through 34 also serve to divide plate 20 and hence each of the portions of plate 20 comprising the cover flap 22, the hinge 24 and the lug 26 into five adjacent portions to form the necessary, separable hinge sections 240, 241, 242, 243 and 244 comprising the five adjacent sections of coined hinge 24; and separable lug sections 260, 261, 262, 263 and 264 comprising the five adjacent sections of the lug 26. Each lug section is opposite to a hinge section and each hinge section is opposite to a divided section of cover flap 22. Thus, breakage of plate 20 along any of the grooves, 31, 32, 33 and 34 simultaneously breaks off sections of cover flap 22, separable hinge sections 240 through 244 and separable lug sections 260 through 264. Due to the aforementioned spacing of the grooves, of the five adjacent sections of cover flap 22, hinge 24 and lug 26, central portion of cover flap 22, and central hinge and lug sections 242 and 262 have a greater longitudinal extent than the two outlying, respective cover flap, hinge and lug sections on either side thereof. These central sections of the cover flap 22, the hinge 24 and the lug 26 can therefore be said to correspond to the shortest of possible mail slots.

In any event, the remaining portions of plate 20, after breakage thereof, provide a cover flap 22 operable for pivotable movement with respect to mail slot 12. A major advantage of the separable hinge and lug sections is that the length of hinge 24 and the length of lug 26 can be reduced for a compact installation that provides a maximum spacing between the points of attachment of plate 20 for maximum stability of cover flap 22 in its pivotable movement.

The hinge sections 240 through 244 are respectively connected to each other, being formed from hinge 24 of plate 20, as well as to the respective, adjacent five sections of plate 20, so divided by the longitudinally extending grooves 31 through 34. Lug sections 260 through 264 can likewise be said to be connected to each other being formed from the lug 26 of plate 20, as well as being connected to the respective adjacent hinge sections 240 through 244. It should be pointed out however, that it is not necessary that the hinge sections 240 through 244 be connected to each other and that the lug sections 260 through 264 be connected to each other. As illustrated in FIG. 8, an embodiment of the subject invention could be formed in which hinge sections would only be connected to portions of a cover flap 22' between the grooves. As such, as illustrated in FIG. 8, a plate 20' could be provided with a groove 31*a'* located only in cover flap 22'. In such embodiment, separable hinge sections 240' and 241' would not be connected to each other, being separated by slot 31*b'*. The same would hold true for the lug sections 260' and 261' which would also be separated by slot 31*b'*. A comparison of FIG. 8 with the preferred embodiment therefore shows that the hinge sections should be at least connected to the divided sections of the cover flap and the lug sections should be at least connected to the respectively opposite hinge sections. The embodiment of FIG. 8 would however be less desireable because of the complexity of providing slots, such as illustrated slot 31*b'*. In this regard, it is understood that other embodiments of the subject invention are possible including embodiments incorporating different hinges, separate formation and attachment of the cover flap 22, hinge sections 240 through 244 thereto and lug sections 260 through 264 to hinge sections 240 through 244. As can be appreciated by those skilled in the art, since different hinges are attached in different manners, the lug sections could be deleted in an appropriate case and the usual attachment points appropriate for the hinge actually used substituted for such lug sections.

In the preferred embodiment, the cover flap 22 is provided with a pair of longitudinally extending grooves 35 and 36. The grooves 35 and 36, intersect the transversely extending grooves 31 through 34 at right angles. These grooves further divide the cover flap 22 of the plate 20 to permit incremental reduction of the width of plate 20 and hence cover 1 by the spacing between the grooves 35 and 36 and the longitudinal edges 20*c* and 20*d*. It is of course possible to have less or more grooves. However, there should be at least one groove dividing the cover flap 22 into two portions. This groove can comprise a groove 31*a'*, as illustrated in FIG. 8 or as in the preferred embodiment, a segment of a transversely extending groove 31, extending in the portion of plate 20 forming the cover flap 22.

Referring now to FIG. 2, it can be seen that the grooves can preferably have a 'V' shaped crossection. As is well known in the art, such a groove adds a stress intensification factor along its length to facilitate the tearing and the breaking of plate 20. As can be seen from FIG. 4, since the cover flap 22 is of sufficient size to fully cover the outer edges of mail slot 12 and weather-stripping arrangement 18, sections of plate 20 including cover flap 22, hinge sections 240 and 244 and lug sections 260 and 264 have all been broken off along the line of grooves 31, 34 and 36 between such grooves and the edges 20*a*, 20*b* and 20*d*, and discarded prior to installation to form the cover 1 illustrated in FIG. 1. The formed cover 1 has a cover flap 22 operable for pivotable movement and of sufficient size to fully cover weather-stripping arrangement 18 and mail slot 12.

It is preferred that the grooves 31 through 36 be all formed in the surface of plate 20 facing the mail slot 12, as viewed when the cover 1 is installed. They could of course be formed on either of the surfaces of the plate 20, however the illustrated embodiment is preferred because the grooves are thus hidden when cover 1 is installed.

Referring now to FIGS. 2 and 3, means for releasably securing the cover flap 22 in its closed position can be provided. These means can include an adhesive magnetic strip 40 and an adhesive ferrite strip 42. The ferrite strip 42 is disposed beneath weather-stripping 18. Magnetic strip 40 is attached to cover flap 22 on the side thereof facing away from the mail slot 12 when cover 1 is installed on building structure 10. Magnetic strip 40 is located on cover flap 22 so as to overlie strip 42 to attract the same when cover flap 22 is in its closed position. Adhesive ferrite strip 42 and adhesive magnetic strip 40 are preferred because they are attached by simply pressing the same into position. It is understood that a bar magnet and metallic strip capable of attracting the magnet could be provided in place of the adhesive magnetic strip 42 and the adhesive ferrite strip 40. The disadvantage of such an arrangement would be that such a bar magnet and metallic strip would have to be separately cemented to respectively cover flap 22 and either bezel plate 16 or building structure 10. It is also understood that the magnetic strip 42 and the ferrite strip 40 could be deleted in its entirety. In such case however, the ability of cover flap 22 to seal mail slot 12 would be decreased in high winds.

Figure 5:
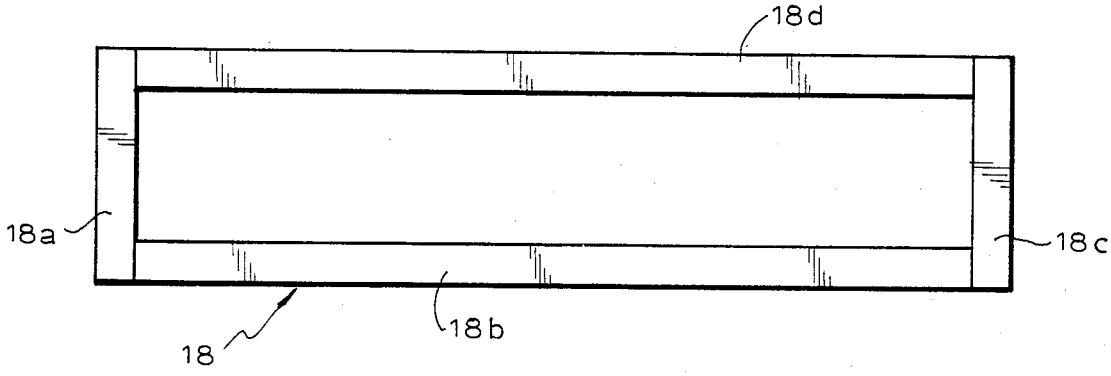
FIG. 5 is a front elevational view of the preferred arrangement of weather-stripping to be used with the present invention.

It should be pointed out that the weather-stripping arrangement 18 could be formed from strips 18*a*, 18*b*, 18*c* and 18*d* as illustrated in FIG. 5. These strips, 18*a* through 18*d* can be cut from a strip of adhesive, closed cell vinyl foam and pressed onto mail slot bezel plate 16 as illustrated in FIG. 2; or alternately, when plate 16 is not used, pressed directly onto building structure 10, as illustrated in FIG. 7.

The pivotable attachment means can include attachment tabs, such as 50 and 52. Attachment tabs 50 and 52 are utilized when a bezel plate 16 is utilized. FIG. 7 illustrates a typical alternate installation when bezel plate 16 is not used. Such an installation uses attachment tabs, such as 50' and screws 58 and 59. As illustrated, the installation using tabs 50 and 52 could likewise also use screws 58 and 59.

Referring now to FIG. 6, an arrangement tab such as attachment tab 50 is illustrated. The attachment tabs 50 and 52 (Which are identical) are disposed between the building structure 10 and plate 20. Tabs 50 and 52 are sized and spaced apart from one another while underlying the lug 26 remaining after possible breakage of plate 20. The attachment tabs 50 and 52, thus typically illustrated as tab 50, have a pair of opposed, self-adhering surfaces 51 and 53, each respectively contacting lug 26 of plate 20 and building structure 10 to attach plate 20 thereto. The tabs, such as illustrated 50 have a thickness "t", equal to the sum of the thicknesses of weather-stripping 18 and bezel plate 16.

Figure 1:
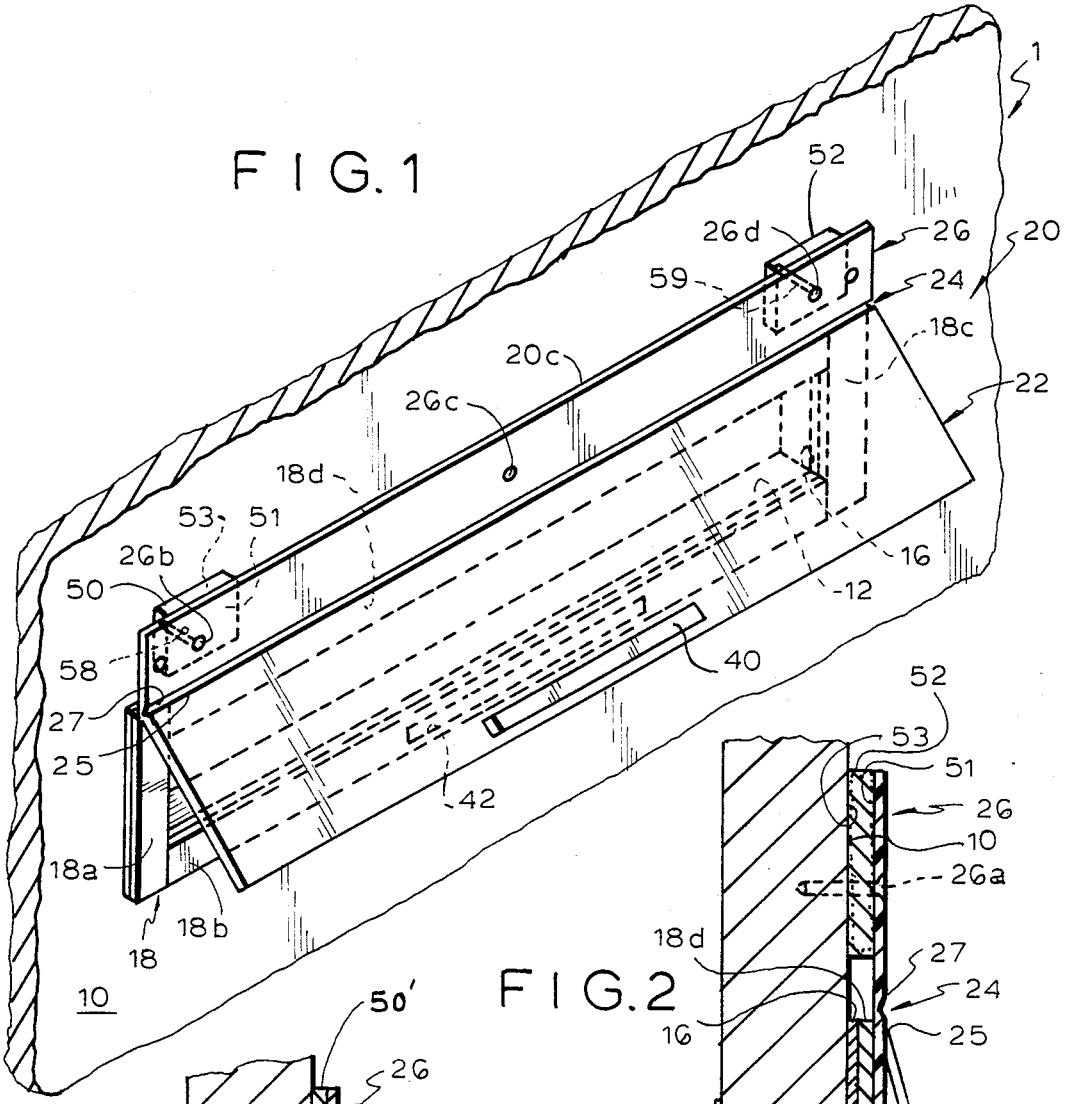
FIG. 1 is a front perspective view of the preferred indoor mail slot cover of the present invention illustrated in an opened position. Portions of the illustrated indoor mail slot cover have been broken off and discarded prior to installation.

The major difference between attachment tab 50 and an alternate attachment tab 50' is that attachment tab 50' has a thickness equal to that of the weather-stripping 18. In practice, attachment tab 50' could be formed from a small cut strip of material forming weather-stripping 18. Thus, another difference between attachment tab 50 and alternate attachment tab 50' is that only one of the surfaces of attachment tab 50' is self-adhering. However, neither of the surfaces need be self-adhering; and when attachment tab 50' is used, the plate 20 must be securred to building structure 10 by provision of screws 58 and 59. The screws 58 and 59 extend through lug 26, the two attachment tabs such as 50' (Deployed as attachment tabs 50 and 52,) and into building structure 10. As stated previously, screws 58 and 59 could be used in a like manner with attachment tabs 50 and 52. In order to facilitate the extension of screws 58 and 59 through lug 26, a set of holes can be provided in lug 26 such as holes 26*a*, 26*b*, 26*c*, 26*d*, and 26*e*. As illustrated, two pairs of holes 26*a*,26*b* and 26*d*,26*e* are each respectively located on either side of the innermost of the transversely extending grooves 32 and 33. As illustrated in FIG. 1, holes 26*b* and 26*d* were used so that attachment tabs 50 and 52 did not abut transverse edges 20*a* and 20*b*. In order to preserve a maximum spacing of the attachment, each tab should at least underlie one of the holes of each of the pairs. Centrally located hole 26*c* allows the use of another tab 50 or 50' and screw such as 58. In this regard, when a bezel plate 16 is used, a third attachment tab, such as illustrated 50, could be used without screws.

The plate 20 and its associated components, cover flap 22, coined hinge 24 and lug 26, as well as attachment tabs 50 and 52 can be formed from a variety of plastics that will take an integrally formed coined hinge, be brittle enough to cleanly break along grooves 31 through 36 and withstand a range of temperature extremes without warping. An example of a suitable material is vinyl. An example of a plate 20 formed from vinyl could have principal dimensions of about 31.73 cm×10.15 cm×0.049 cm. The grooves could have a depth of about 0.025 cm. and a spacing of about 1.27 cm from the edges of plate 20 and from groove to groove. In such an embodiment, as in the illustrated preferred embodiment cover flap 22 should have a greater transverse extent than hinge 24 and lug 26; and thus can be sized at about 31.73 cm×7.61 cm. The reason for this is of course to conserve material. Attachment tabs 50 and 52 can each be about 2.54 cm×1.9 cm. Alternate attachment tabs, such as 50' would have the same gross dimensions as attachment tabs such as 50. The thickness of an attachment tab such as 50 could be about 0.635 cm. The thickness of an attachment tab such as 50' would of course depend upon the weather-stripping used.

It will be understood by those skilled in the art that the invention has been described with reference to an exemplary preferred embodiment and that variations and modifications, other than those previously described, can be effected in the described embodiment without departing from the spirit and scope of the invention.

What is claimed is:

1. An indoor mail slot cover that can be reduced in size prior to installation in accordance with the size of said mail slot and that can seal said mail slot by covering said mail slot and a weather-stripping arrangement installed about said mail slot directly on a building structure or on a mail slot bezel plate attached to a building structure, said cover comprising:

a plastic plate having:

a cover flap portion sized to cover said mail slot;

at least one transversely extending groove, located in at least said cover flap portion, said at least one transversely extending groove dividing said cover flap into a pair of adjacent sections;

a lug portion, spaced from said cover flap portion and located directly opposite thereto for connecting said plate to said building structure, said lug portion having at least a pair of separable lug sections, each of which is located opposite to a said second of said cover flap portion; and a hinge portion located between said lug and said cover flap portions, said hinge portion comprising an integrally formed coined hinge having at least a pair of adjacent separable, hinge sections, each of which connects a said separable lug section to a said section of said cover flap portion; and means for attaching at least a said lug section to said building structure, whereby when prior to installation one of said adjacent sections of said cover flap portion is of sufficient size to fully cover said mail slot and said weather-stripping arrangement, the other of said adjacent sections of said cover flap portion, simultaneously with a said hinge section and a said lug section connected thereto, can be broken off along the line of said at least one transversely extending groove and then discarded to thereby reduce the size of said cover flap portion and leave the remaining of said adjacent sections thereof operable for pivotable movement with respect to said mail slot between an opened position, uncovering said mail slot and a closed position, covering said mail slot and said weather-stripping arrangement.

2. The indoor mail slot of claim 1 wherein said plate is of rectangular configuration and has a pair of longitudinal edges spaced apart from one another and a pair of transverse edges spaced apart from one another, said transverse edges connecting said longitudinal edges at either end thereof to define the said rectangular configuration of said plate and wherein said at least one transversely extending groove is parallel to said transverse edges.

3. The indoor mail slot cover of claim 2 wherein said at least one transversely extending groove further extends into said hinge and said lug portions to define said separable hinge and said separable lug sections on either side of said at least one transversely extending groove.

4. The indoor mail slot cover of claim 3 wherein said coined hinge is only formed in the surface of said plate facing away from said mail slot as viewed when said indoor mail slot cover is installed on said building structure.

5. The indoor mail slot cover of claim 4 wherein said cover flap portion has a greater transverse extent than said lug and said hinge portions.

6. The indoor mail slot cover of claim 5 wherein said plate further has a set of two pairs of transversely extending grooves, parallel to said transverse edges of said plate, each of said pairs being spaced an equal distance from said transverse edges and said pairs being spaced apart from one another an interval greater than that of said distance, said pairs further dividing said cover flap portion, said hinge and said lug portions into a set of five adjacent sections, wherein the central sections of each have a greater longitudinal extent than the two sections outlying each of said central sections on either side therof, and wherein said lug portion further includes a set of five separable lug sections comprising said five adjacent sections of said lug, and said hinge portion further includes a coined hinge having a set of five separable hinge sections comprising said five adjacent sections of said coined hinge, whereby the length of said plate and hence said indoor mail slot cover can be incrementally reduced by the spacing between said transversely extending grooves and said transverse edges of said plate.

7. The indoor mail slot cover of claim 6 wherein said plate further has a pair of longitudinally extending grooves located in said cover flap portion, intersecting said pairs of transversely extending grooves at right angles, further dividing said cover flap portion into a pair of further sections whereby the width of said plate and hence said indoor mail slot cover can also be incrementally reduced by the spacing between said longitudinally extending grooves and said longitudinal edges of said plate.

8. The indoor mail slot cover of claim 7 wherein all of said grooves are formed in the surface of said plate facing said mail slot as viewed when said indoor mail slot cover is installed.

9. The indoor mail slot cover of claim 8 wherein all of said grooves have a 'V' shaped crossection.

10. The indoor mail slot cover of claim 9 further comprising means for releasably securing said cover flap portion in its said closed position.

11. The indoor mail slot cover of claim 10 wherein said releasable securing means include an adhesive ferrite strip disposed beneath said weather-stripping arrangement and an adhesive magnetic strip attached to said cover flap portion on the said surface thereof facing away from said mail slot after the installation thereof at a location thereon so as to overlie said ferrite strip to attract said ferrite strip when said cover flap portion is in its said closed position.

12. The indoor mail slot cover of claim 11 wherein wherein said attachment means include a pair of attachment tabs disposed between said building structure and said plate, said attachment tabs sized and spaced apart from one another so as to underlie said lug sections remaining after possible breakage of said plate.

13. The indoor mail slot cover of claim 12 wherein said weather-stripping arrangement is installed on said bezel plate and said attachment tabs have a pair of opposed self-adhering surfaces, each respectively contacting said lug sections remaining after possible breakage of said plate and said building structure to attach said plate thereto, and a thickness, separating said surfaces, equal to the sum of the thicknesses of said weather-stripping arrangement and said bezel plate.

14. The indoor mail slot cover of claim 12 wherein said weather-stripping arrangement is installed on said bezel plate, said attachment tabs have a pair of opposed self-adhering surfaces, each respectively contacting said lug sections remaining after possible breakage of said plate and said building structure to attach said plate thereto and a thickness, separating said surfaces, equal to the sum of the thicknesses of said weather-stripping arrangement and said bezel plate and wherein said lug portion has at least a set of two pairs of holes, each pair of which is respectively located on either side of the innermost of said transversely extending grooves, and each of said attachment tabs underlies at least one of said holes of a said pair, and wherein said attachment means include at least a pair of screws, each of which extends through said one of said holes of said pair of holes, one of said attachment tabs and said building structure.

15. The indoor mail slot cover of claim 12 wherein said weather-stripping arrangement is installed on said building structure, said attachment tabs each have a thickness equal to that of said weather-stripping arrangement and wherein said lug portion has at least two pairs of holes, each pair of which is respectively located on either side of the innermost of said transversely extending grooves, and each of said attachment tabs underlies at least one of said holes of a said pair, and said attachment means include at least a pair of screws, each of which extends through said one of said holes of said pair of holes, one of said attachment tabs and said building structure.

* * * * *

UNITED STATES PATENT AND TRADEMARK OFFICE

CERTIFICATE OF CORRECTION

PATENT NO. : 4,545,522

DATED : Oct. 8, 1985

INVENTOR(S) : Gary D. Kerzner

It is certified that error appears in the above-identified patent and that said Letters Patent is hereby corrected as shown below:

In the drawings, Sheet 2, Fig. 4, the reference numeral "261'", should read --261--.

Signed and Sealed this

*Fourteenth* Day of *January 1986*

[SEAL]

*Attest:*

*Attesting Officer*

DONALD J. QUIGG

*Commissioner of Patents and Trademarks*